United States Patent [19]

Castel

[11] 4,079,841

[45] Mar. 21, 1978

[54] MODULAR DISPLAY UNIT FOR BOOKS OR THE LIKE, AND MODULE FOR USE THEREIN

[75] Inventor: Larry Castel, Stamford, Conn.

[73] Assignee: Coats & Clark, Inc., Stamford, Conn.

[21] Appl. No.: 749,404

[22] Filed: Dec. 10, 1976

[51] Int. Cl.[2] ..... A47F 5/02

[52] U.S. Cl. ..... 211/131; 211/50; 211/163

[58] Field of Search ..... 211/50, 55, 88, 163, 211/131, 133, 188, 194; 403/364, 354

[56] References Cited

U.S. PATENT DOCUMENTS

| | | | |
|---|---|---|---|
| 947,190 | 1/1910 | Rose | 211/50 |
| 1,070,239 | 8/1913 | Ferguson | 211/50 |
| 1,515,058 | 11/1924 | Lindhe | 211/50 |
| 1,970,868 | 8/1934 | Rubenstein | 211/50 X |
| 1,997,829 | 4/1935 | McKee | 211/50 X |
| 2,302,188 | 11/1942 | Carrier | 211/50 |
| 2,738,075 | 3/1956 | Guignard et al. | 211/163 X |
| 3,223,247 | 12/1965 | Bleed | 211/163 |
| 3,895,720 | 7/1975 | Presberg | 211/50 |
| 3,942,647 | 3/1976 | Crosslen | 211/163 X |
| 3,993,196 | 11/1976 | Immordino | 211/163 X |

*Primary Examiner*—Roy D. Frazier
*Assistant Examiner*—Robert W. Gibson, Jr.
*Attorney, Agent, or Firm*—Burgess, Ryan and Wayne

[57] ABSTRACT

A carousel type unit for displaying consumer articles or products, said unit having a number of hexagonal plates rotatably mounted on a vertical support post. Each hexagonal plate has six display modules, one module being mounted to each of its six edges. The top edges of the modules mounted to each hexagonal plate are interlocked with the bottom edges of the modules mounted to the next higher plate. The modules are constructed so that a portion of the top edge of each module has a barbed configuration, and the bottom edge of each module has a corresponding bifurcated configuration, so that the top edge of any module can be interlocked with the bottom edge of any other module. Each module comprises an open enclosure with three co-planar retaining lips for allowing the above indicated products to be retained within the module while permitting the front surfaces to be exposed to view.

11 Claims, 11 Drawing Figures

MODULAR DISPLAY UNIT FOR BOOKS OR THE LIKE, AND MODULE FOR USE THEREIN

This invention relates to a module for displaying various consumer articles such as books and other consumer articles including, for example, hosiery articles such as stockings, underwear, and the like, and to an interlocked array of such modules.

There are, for example, many types of display arrangements known in the art for displaying books, magazines, etc. However, there is need for a modular type of display unit for such items, wherein the modules may be arranged in any of a number of desired configurations, and wherein the construction of each module is such that it may be manufactured by a relatively inexpensive molding process.

Consumer articles or products as herein employed is intended to include men's and women's wear such as hosiery, underwear, ties, etc, books, cosmetic items such as lipsticks, colognes, perfumes, etc. jewelry items such as watches, pins, rings, bracelets, etc., pharmaceuticals, stationery items, and the like.

The term "books" inclues hard cover books, soft cover books, instruction books, pamphlets, sheets of printed literature, magazines, printed forms, and similar materials.

Accordingly, an object of the present invention is to provide an improved module for displaying various articles, and an interlocked array of said modules.

Accordingly, as herein described there is provided a module for displaying the aforesaid consumer articles or products, said module having a rear wall, said wall having top and bottom edges and two side edges, a pair of side walls extending from respective ones of said side edges in planes substantially perpendicular to the plane of said rear wall, a bottom wall extending from said bottom edge between said side walls in a plane substantially perpendicular to the plane of said rear wall, a pair of retention lips extending from each of said side walls in a common plane parallel to the plane of said rear wall, a third retention lip extending from said bottom wall in said common plane, said lips cooperating with said walls to form an open enclosure for retaining the products to be displayed, at least a portion of a selected one of the top and bottom edges of said rear wall having a barbed configuration, at least a portion of the other of said top and bottom edges of said rear wall comprising resilient material having a corresponding bifurcated configuration, so that the top edge of one of said modules may be engaged with the bottom edge of another of said modules by interlocking of the barbed portion of the first module with the bifurcated portion of the other module, said rear wall having means adapted to secure said module to a support.

According to another aspect of the inventon there is also provided an interlocked array of modules for displaying the aforesaid products or articles, each module of said array having a rear wall, said wall having top and bottom edges and two side edges, a pair of side walls extending from respective ones of said side edges in planes substantially perpendicular to the plane of said rear wall, a bottom wall extending from said bottom edge between said side walls in a plane substantially perpendicular to the plane of said rear wall, a pair of retention lips extending from each of said side walls in a common plane parallel to the plane of said rear wall, a third retention lip extending from said bottom wall in said common plane, said lips cooperating with said walls to form an open enclosure for retaining the products to be displayed, at least a portion of a selected one of the top and bottom edges of said rear wall havng a barbed configuration, at least a portion of the other of said top and bottom edges of said rear wall comprising resilient material having a corresponding bifurcated configuration, so that the top edge of one of said modules may be engaged with the bottom edge of another of said modules by interlocking of the barbed portion of the first module with the bifurcated portion of the other module, said rear wall having a gripping member extending therefrom in a direction away from said lips and adapted to secure said module to a support, wherein said array comprises:

a vertical post;

at least two horizontal polygonal plate members disposed above each other on said post, each of said plate members having a plurality of outer edges, each of said edges having a length at least equal to the distance between the side walls of one of said modules, each of said edges having a module engaging portion adapted to mate with said gripping member;

a plurality of said modules being disposed about the periphery of each of said plate members, one module being disposed adjacent each of said outer edges with the gripping member thereof in mating engagement with the engaging portion of the corresponding edge, and at least one of the top edges and bottom edges of the modules adjacent the periphery of each of said plate members being interlocked with the opposite edges of the modules adjacent the periphery of another of said plate members.

The invention will be better understood by reference to the following specification, which describes a preferred embodiment of the invention, taken in conjunction with the accompanying drawings, in which.

Figure 1:
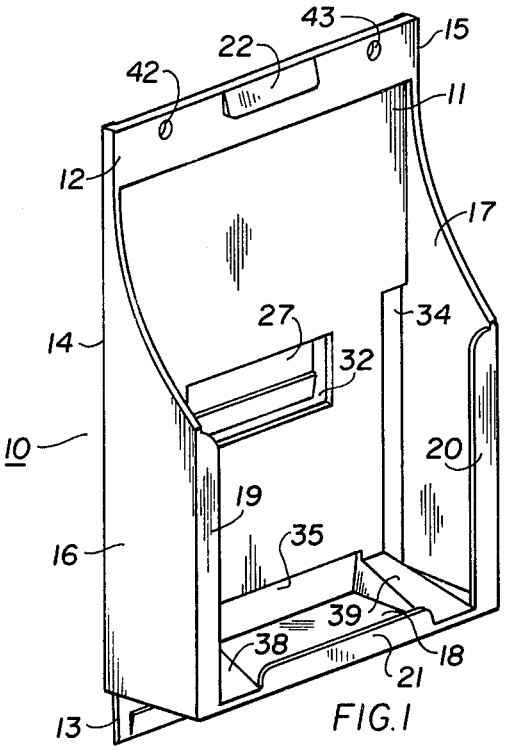
FIG. 1 is a front perspective view of a display module according to a preferred embodiment of the invention.
Figure 2:
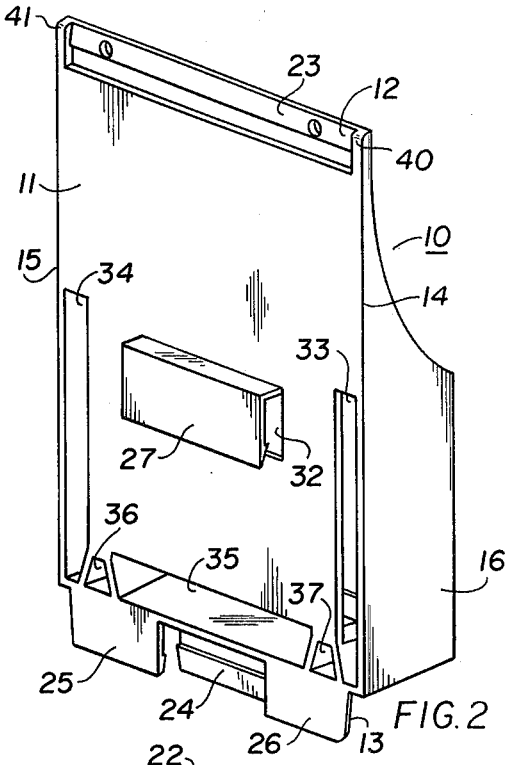
FIG. 2 is a rear perspective view of the module of FIG. 1.
Figure 8:
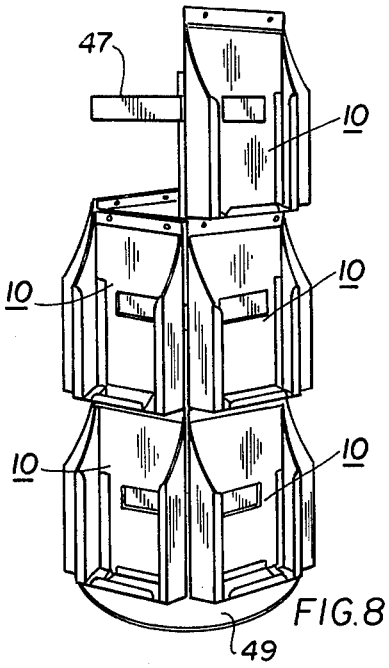
FIG. 8 shows a portion of a carousel display unit comprising a number of modules of the type shown in FIG. 1.
Figure 9:
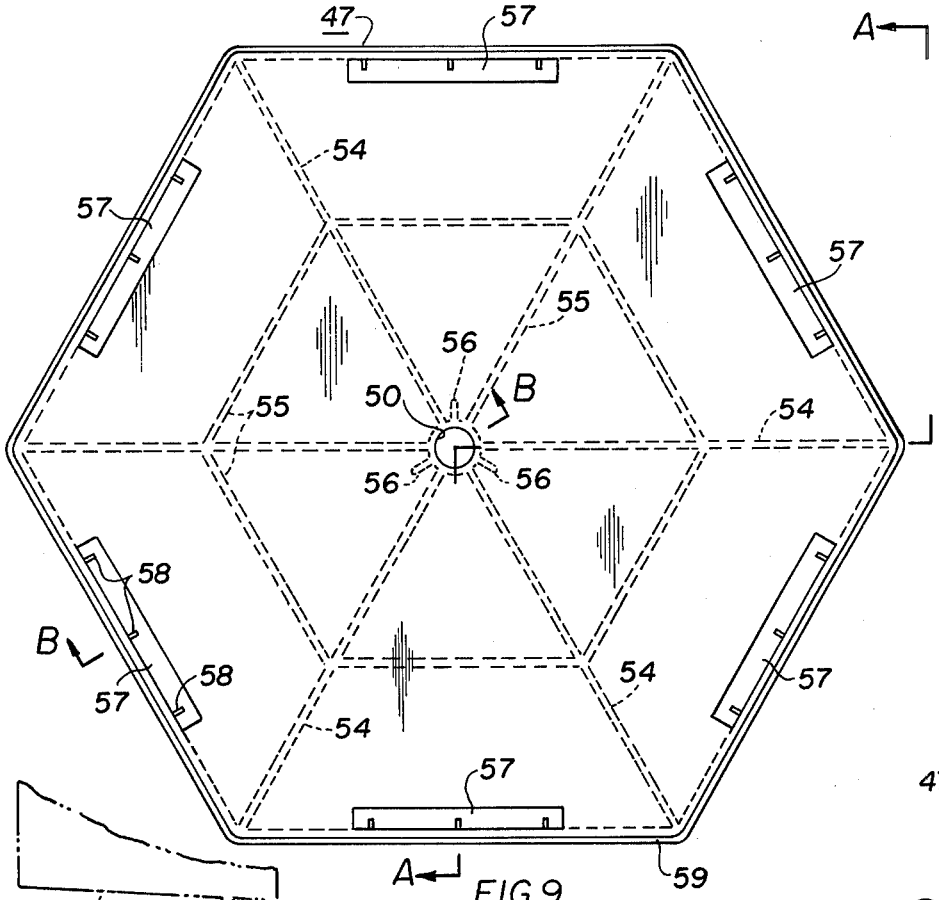
FIG. 9 shows a plan view of a hexagonal plate member employed in the carousel unit of FIG. 8.
Figure 10:
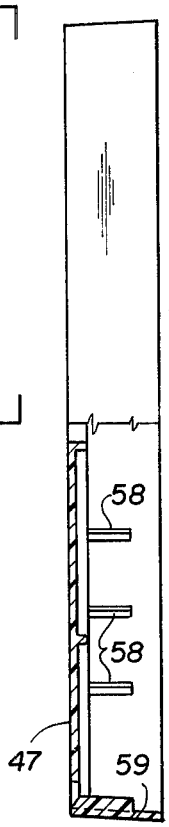
Figure 11:
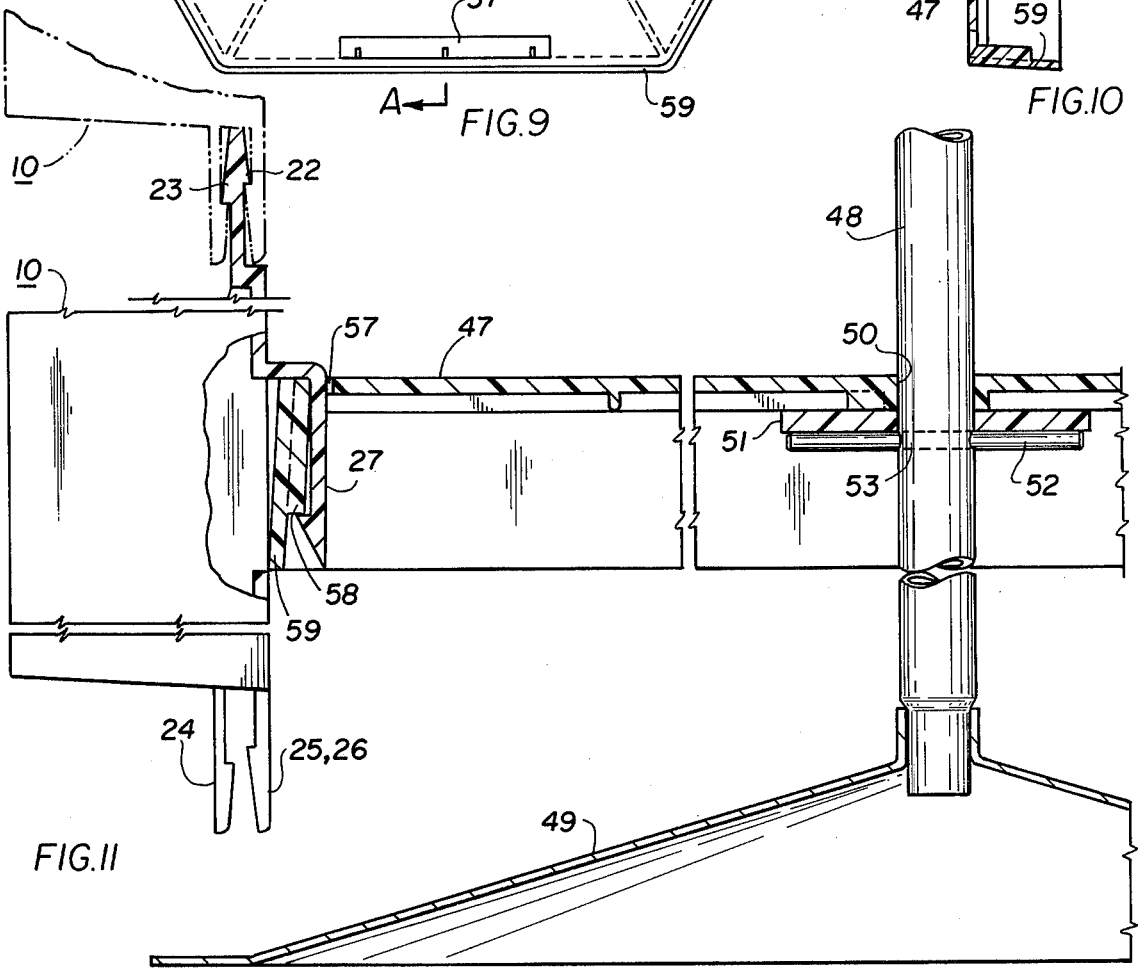

FIG. 10 shows a right side view of the plate member shown in FIG. 9, taken along the staggered section A—A; and FIG. 11 is a partial cross-sectional view of the carousel unit shown in FIG. 8, taken along the cutting plane B—B as shown in FIG. 9, and showing a portion of the carousel base, vertical support post, lowest hexagonal plate member, and a module of the type shown in FIG. 1 mounted on an edge of said plate member.

As shown in FIGS. 1-4, a display module 10 is formed of a single piece of a suitable plastic material. The module 10 may be formed by a single injection molding process at relatively low cost. Suitable plastics for the structure of the module 10 are polystyrene and acrylonitrile-butadiene-styrene ("ABS"). These plastics have satisfactory strength characteristics, are suitable for use in an injection molding process, and have sufficient resilience to provide the desired interlocking functions as hereafter described.

The module 10 is in the form of an open enclosure having a rear wall 11, said rear wall having a top edge 12, a bottom edge 13, a left edge 14 and a right edge 15. Side walls 16 and 17 extend from the edges 14 and 15 respectively in planes substantially perpendicular to the plane of the rear wall 11. A bottom wall 18 extends from the bottom edge 13 between the side walls 16 and 17 in a plane substantially perpendicular to the plane of the rear wall 11.

A pair of retention lips 19 and 20 extends from each of the side walls 16 and 17 in a common plane parallel to the plane of the rear wall 11. A third retention lip 21 extends from the bottom wall 18 in the same common plane as the lips 19 and 20. The lips 19, 20 and 21 cooperate with the walls 11, 16, 17 and 18 to form an open enclosure for retaining the articles to be displayed.

Figure 3:
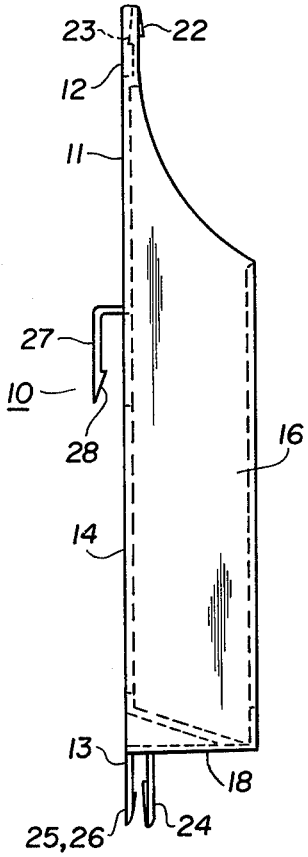
FIG. 3 is a left side view of the module of FIG. 1.
Figure 4:
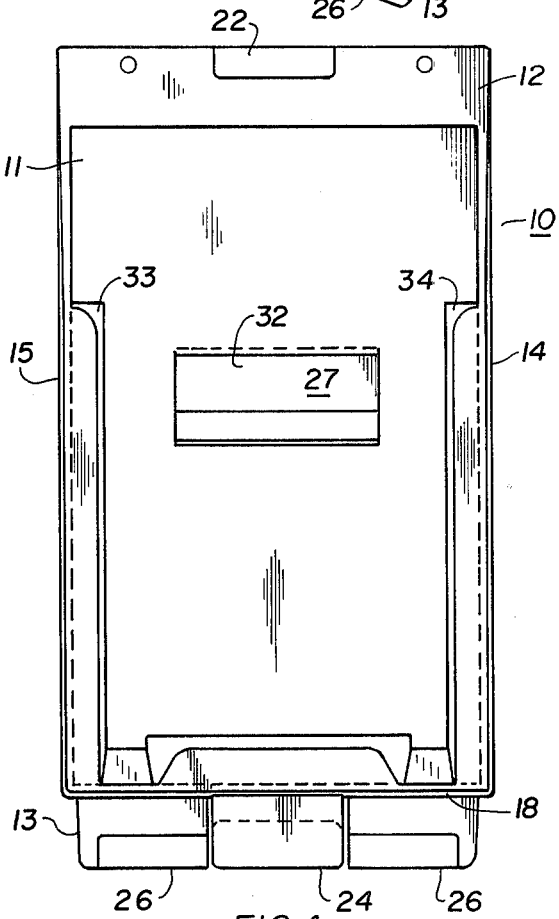
FIG. 4 is a front view of the module of FIG. 1.

As seen most clearly in FIG. 3, a portion of the top edge 12 of the rear wall 11 has a barbed configuration, i.e. with the appearance of an arrow point or spear point in side view. This barbed configuration has a first barbed part 22 disposed on the enclosure side of the rear wall, and a second barbed part 23 disposed on the opposite side of said rear wall 11. The lengths of the barbed parts 22 and 23 are different from each other, with the barbed part 23 having slightly greater length. The purpose of having these barbed parts of different lengths is to distribute the resulting stress when the top edge of one of the modules 10 is interlocked with the bottom edge of another such module, i.e. so that the stress occurs at two different points (the shoulders of the barbed parts 22 and 23), rather than at a single region as would be the case if the barbed parts 22 and 23 had the same length. This asymmetrical arrangement of the barbed parts 22 and 23 results in increased overall strength of the resulting interlocked module array.

The bottom edge 13 of the rear wall 11 comprises resilient material (such as the plastic material previously mentioned) having a bifurcated configuration (in side view) corresponding to the barbed configuration of the top edge 12, so that the top edge 12 of one of the modules 10 may be engaged with the bottom edge 13 of another of said modules by interlocking of the barbed portion 22, 23 of the first module with the bifurcated portion 24, 25, 26 of the other module.

Figure 7:
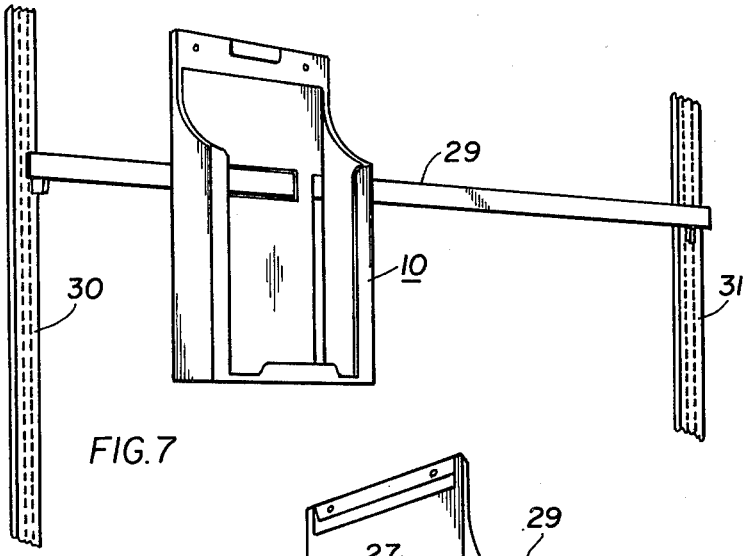
FIG. 7 shows a front perspective view of the module of FIG. 1 mounted on a horizontal spanner bar.
Figure 6:
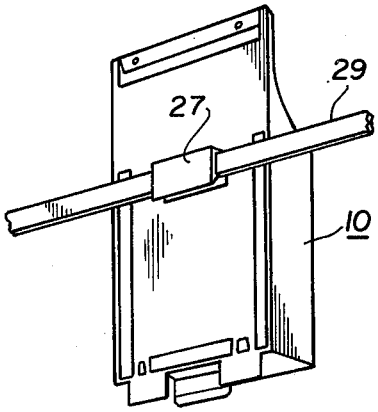
FIG. 6 shows a rear perspective view of the module of FIG. 1 mounted on a horizontal spanner bar.

Extending from the rear wall 11 in a direction opposite to the enclosure is a resilient gripping member 27 having a barbed edge 28. This gripping member may be utilized to secure the module 10 to a horizontal spanner bar 29 of 29' of a corresponding rectangular cross-section, as shown in FIGS. 6, 7 of 8. The barbed edge 28 retains the module 10 in position against vertical upward movement with respect to the spanner bar 29. As shown in FIG. 7, the spanner bar 29 is horizontal and may be supported at any desired height by the vertical support strips 30 and 31.

As many of the modules 10 as is desired, or as can be accommodated, may be mounted side by side on a single spanner bar 29. Additional spanner bars 29 may be mounted at higher or lower heights between the support strips 30 and 31, with additional ones of the modules 10 secured to said spanner bars by means of their gripping members 27, and the top edges of each row of modules 10 being interlocked with the bottom edges of the next higher row of said modules by engagement of the barbed parts 22, 23 of said top edges with the bifurcated parts 24, 25, 26 of said bottom edges. The resulting planar array of modules 10 has an attractive appearance and good structural strength.

In order to facilitate the manufacture of the module 10 by a single injection molding process, the rear wall 11 is provided with apertures 32, 33, 34, 35, 36 and 37, through which portions of the mold may extend to form the corresponding module portions 27, 19, 20, 21, ramp 38, and ramp 39 respectively. The ramps 38 and and 39 slope upwardly from the lip 19, toward the rear wall 11, and provide the additional function of causing the materials retained in the module 10 to have their bottom edges slide forward as part of the materials are removed, the resulting tilting of the remaining materials making it easy to scan a large array of such modules to determine which modules require replenishment of their contents.

The barbed part 22 of the top edge 12 of the module 10 is centrally disposed between the side edges 14 and 15. Similarly, the barbed part 24 of the lower edge 13 is also so centrally disposed, and has a width substantially equal to the width of the barbed part 22. The barbed parts 25 and 26 of the bottom edge 13 are disposed on opposite sides of the central barbed part 24, and lie in a different plane from that of the part 24.

Figure 5:
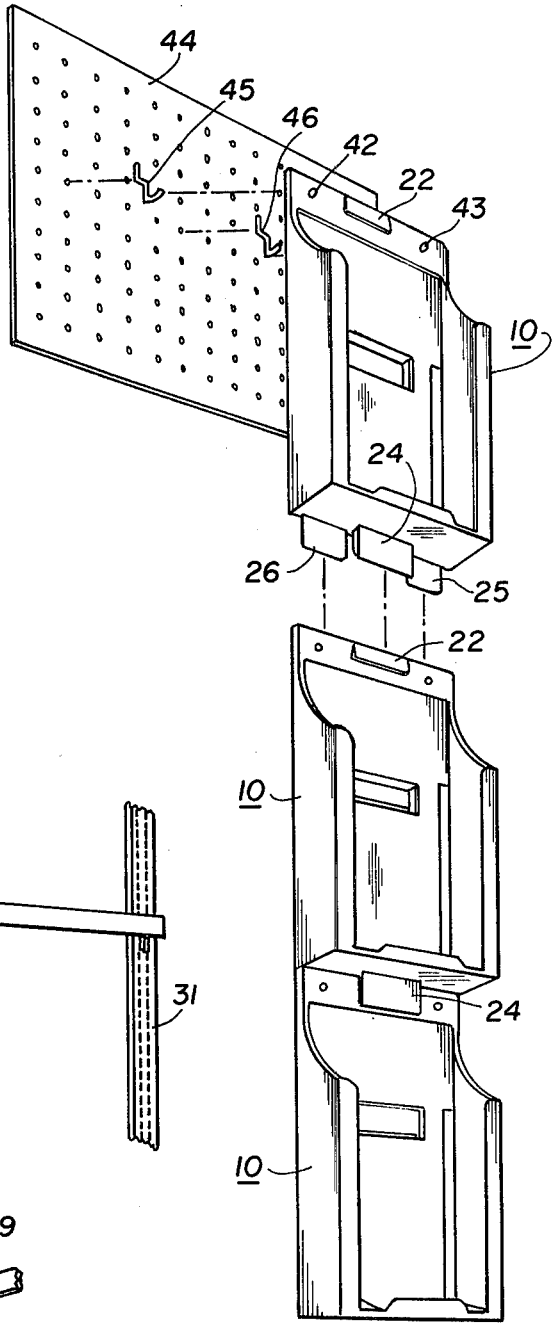
FIG. 5 illustrates the manner in which the top and bottom edges of adjacent modules of the type shown in FIG. 1 may be interlocked, and/or mounted to a pegboard surface.

The manner in which a number of the modules 10 may be vertically interlocked is illustrated in FIG. 5, wherein it is seen that this interlocking is achieved by engagement of the barbed part 24 of the bottom edge 13 with the barbed part 22 of the top edge 12, and also by engagement of the barbed parts 25 and 26 of the bottom edge 13 with the barbed part 23 of the top edge 12. The narrow shoulder portions 40 and 41 (See FIG. 2) of the left and right side portions of the top edge 12 abut against the left and right edges of the barbed parts 26 and 25 respectively to prevent relative horizontal movement of the engaged modules.

As a result of the aforementioned interlocking portions of the top and bottom edges of adjacent modules, the interlocked structure provides a great deal of strength and rigidity.

As indicated in FIG. 5, each of the modules 10 is also provided with two holes 42 and 43 which may be utilized to attach one or more of the modules to a vertical surface by means of screws, or to a pegboard surface 44 by means of pegboard hooks 45 and 46.

The carousel structure shown in FIG. 8 comprises a number of interlocked ones of the modules 10, suported by hexagonal mounting plates 47 (See FIG. 9), each of the mounting plates 47 being rotatably mounted on a post 48 (See FIG. 11), with the post 48 being secured to a tulip-shaped or conical mounting base 49.

The resulting carousel arrangement shown in FIG. 8 may be easily rotated by hand to bring a desired module or modules into view, and said array exhibits good structural strength. On each tier of the array shown in FIG. 8, six of the modules 10 are mounted on corresponding edges of the corresponding one of the hexagonal plate members 47. The top edges 12 of the six modules of the lowest tier are interlocked with the bottom edges 13 of the six modules of the next highest tier, as previously discussed, the top edges of said modules of said next highest tier are interlocked with the bottom edges of the modules of the tier above them, etc. Each of the hexagonal plate members 47 has a central hole 50 therein through which the post 48 extends, the inner diameter of the hole 50 being slightly greater than the outer diameter of the post 48. As seen in FIG. 11, the lowermost of the hexagonal plate members 47 is maintained at a desired height on the post 48 by means of a plastic washer 51, which may comprise polystyrene or ABS. The washer 51 is held at a desired height on the post 48 by means of an underlying pin 52 which extends through a hole 53 in the post 48.

The plate members 47 may be made of any suitable material, a relatively high strength plastic such as polystyrene or ABS being preferred.

The carousel array shown in FIG. 8 employs at least two of the plate members 47, although, with a post 48 of suitable length, any desired number of such plate members may be utilized. While a hexagonal structure for the plate members 47 has been described, said plate members may have any desired polygonal structure, preferably in the form of a regular polygon having the length of each edge corresponding to the width of the module 10.

As seen in FIGS. 9, 10 and 11, the plate member 47 has a web-like structure, with radial support ribs 54 integral therewith, and a circumferential support rib 55. Three short radial projections 56 provide bearing surfaces between the lowermost one of the plate members 47 and the support washer 51. Adjacent each of the outer edges of the plate member 47 is an elongated aperture 57 having a length slightly greater than that of the gripping member 27. Formed in the plate member 47 and extending into the apertures 57 are three vertically oriented ridge portions 58.

Each of the modules 10 is mounted on a corresponding edge of the plate member 47 by engagement of the gripping member 27 thereof with the corresponding ridges 58 (See FIG. 11). The portions of the rear surface 11 of the module 10 adjacent the gripping member 27 abut against the outer edge 59 of the plate member 47, to provide an interlocked mounting of the module 10 on the plate member 47 in cooperation with the action of the gripping member 27.

While specific interconnected arrays of the module 10 have been described, i.e. a planar array utilizing spanner bars (as shown in FIGS. 6 and 7) and a carousel array (as shown in FIG. 8), as well as a planar array utilizing pegboard (as shown in FIG. 5), it should be understood that other types of interlocking arrays utilizing the module 10 will become obvious to those skilled in the art.

What is claimed is:

1. A module for displaying articles, said module having a rear wall, said rear wall having top and bottom edges and two side edges, a pair of side walls extending from respective ones of said side edges in planes substantially perpendicular to the plane of said rear wall, a bottom wall exetnding from said bottom edge between said side walls in a plane substantially perpendicular to the plane of said rear wall, a pair of retention lips extending from each of said side walls in a common plane parallel to the plane of said rear wall, a third retention lip extending from said bottom wall in said common plane, said lips cooperating with said walls to form an open enclosure for retaining the articles or products to be displayed, at least a portion of a selected one of the top and bottom edges of said rear wall having a barbed configuration, at least a portion of the other of said top and bottom edges of said rear wall comprising resilient material having a corresponding bifurcated configuration, said bifurcated portion of said other of said edges comprising a central portion in one plane and two peripheral portions disposed on opposite sides of said central portion in another plane, the barbed portion of said one of said edges having a first barbed part for engaging said central portion and another barbed part for engaging said peripheral portions, so that the top edge of one of said modules may be engaged with the bottom edge of another of said modules by interlocking of the barbed portion of the first module with the bifurcated portion of the other module, said rear wall having means adapted to secure said module to a support.

2. The module according to claim 1, wherein the portions of said bottom wall adjacent said side walls comprise ramps which incline toward said top edge between said lips and said rear wall.

3. The module according to claim 1, wherein said module is of unitary construction.

4. The module according to claim 1, said module having a pair of elongated apertures in said rear wall adjacent respective ones of said side walls, each of said apertures being disposed opposite a corresponding one of said pair of retention lips.

5. The module according to claim 1, wherein said module is capable of being manufactured by a single injection molding process.

6. The module according to claim 1, further comprising means for securing said module to a horizontal bar.

7. The module according to claim 1, further comprising means for securing said module to a vertical pegboard surface.

8. The module according to claim 1, wherein said first and second barbed parts of said barbed portion of said one of said edges are disposed on opposite surfaces of said rear wall, the lengths of said barbed parts being different from each other.

9. An interlocked array of modules for displaying articles or products, each module of said array having a rear wall, said rear wall having top and bottom edges and two side edges, a pair of side walls extending from respective ones of said side edges in planes substantially perpendicular to the plane of said rear wall, a bottom wall extending from said bottom edge between said side walls in a plane substantially perpendicular to the plane of said rear wall, a pair of retention lips extending from each of said side walls in a common plane parallel to the plane of said rear wall, a third retention lip extending from said bottom wall in said common plane, said lips cooperating with said walls to form an open enclosure for retaining articles or products to be displayed, at least a portion of a selected one of the top and bottom edges of said rear wall having a barbed configuration, at least a portion of the other of said top and bottom edges of said rear wall comprising resilient material having a corresponding bifurcated configuration, so that the top edge of one of said modules may be engaged with the bottom edge of another of said modules by interlocking of the barbed portion of the first module with the bifurcated portion of the other module, said rear wall having a gripping member extending therefrom in a direction away from said lips and adapted to secure said module to a support, wherein said array comprises:

a vertical post;

at least two horizontal polygonal plate members disposed above each other on said post, each of said plate members having a plurality of outer edges, each of said edges having a length at least equal to the distance between the side walls of one of said modules, each of said edges having a module engaging portion adapted to mate with said gripping member;

a plurality of said modules being disposed about the periphery of each of said plate members, one module being disposed adjacent each of said outer edges with the gripping member thereof in mating engagement with the engaging portion of the corresponding edge, and at least one of the top edges and bottom edges of the modules adjacent the periphery of each of said plate members being interlocked with the opposite edges of the modules adjacent the periphery of another of said plate members.

10. The array of claim 9, wherein said plate members are rotatably mounted on said post.

11. A module for displaying articles, said module having a rear wall, said rear wall having top and bottom edges and two side edges, a pair of side walls extending from respective ones of said side edges in planes substantially perpendicular to the plane of said rear wall, a bottom wall extending from said bottom edge between said side walls in a plane substantially perpendicular to the plane of said rear wall, a pair of retention lips extending from each of said side walls in a common plane parallel to the plane of said rear wall, a third retention lip extending from said bottom wall in said common plane, said lips cooperating with said walls to form an open enclosure for retaining the articles or products to be displayed, said module having a pair of elongated apertures in said rear wall adjacent respective ones of said side walls, each of said apertures being disposed opposite a corresponding one of said pair of retention lips, at least a portion of a selected one of the top and bottom edges of said rear wall having a barbed configuration, at least a portion of the other of said top and bottom edges of said rear wall comprising resilient material having a corresponding bifurcated configuration, so that the top edge of one of said modules may be engaged with the bottom edge of another of said modules by interlocking of the barbed portion of the first module with the bifurcated portion of the other module, said rear wall having means adapted to secure said module to a support.

* * * * *

UNITED STATES PATENT OFFICE
CERTIFICATE OF CORRECTION

Patent No. 4,079,841 Dated March 21, 1978

Inventor(s) Larry Castel

It is certified that error appears in the above-identified patent and that said Letters Patent are hereby corrected as shown below:

Column 1, line 24: "inclues" should be --includes--.

Column 3, line 57: "of" should be --&--.

Column 4, line 52: "suported" should be --supported--.

Column 5, line 57: "exetnding" should be --extending--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*